US005698334A

United States Patent [19]

Berens

[11] Patent Number: 5,698,334

[45] Date of Patent: Dec. 16, 1997

[54] HORIZONTAL TROPHY

[76] Inventor: Linus I. Berens, 454 Steuben Ave., Forked River, N.J. 08731

[21] Appl. No.: 714,636

[22] Filed: Sep. 12, 1996

[51] Int. Cl.[6] ..... G09F 19/00

[52] U.S. Cl. ..... 428/542.4; 428/15

[58] Field of Search ..... 428/7, 15, 542.4; D11/133, 131, 157, 151

[56] References Cited

U.S. PATENT DOCUMENTS

| | | | |
|---|---|---|---|
| D. 82,300 | 10/1930 | Akin et al. | D34/5 |
| D. 83,195 | 3/1931 | Gibbs et al. | D34/5 |
| D. 84,068 | 5/1931 | Andrus | D34/5 |
| D. 84,224 | 5/1931 | Valvano | D34/5 |
| D. 128,369 | 7/1941 | Gross | D34/5 |
| D. 140,496 | 3/1945 | Brooks | D34/5 |
| D. 195,982 | 8/1963 | Hadley | D42/7 |
| 1,979,431 | 11/1934 | Wupper | 273/123 |
| 3,699,698 | 10/1972 | Shlu | 40/106.35 |
| 4,058,313 | 11/1977 | Spradlin | 273/87.4 |
| 4,095,793 | 6/1978 | Ray | 273/87 R |
| 4,888,251 | 12/1989 | Nakada | 428/542.4 |
| 5,203,566 | 4/1993 | Ricigliano | 273/176 E |

*Primary Examiner*—Alexander Thomas
*Attorney, Agent, or Firm*—Kenyon & Kenyon

[57] ABSTRACT

A horizontal trophy for memorializing an event has an elongated base. A variety of articles selected to depict the event to be memorialized are selected and attached to the upper surface of the elongated base to depict the event and to represent the participants in the event. A label on the base provides information regarding the memorialized event.

17 Claims, 2 Drawing Sheets

HORIZONTAL TROPHY

FIELD OF THE INVENTION

The present invention is directed to trophies and more particularly to horizontal commemorative trophies for depicting an event to be memorialized.

BACKGROUND

A variety of devices such as plaques, medals, pins, trophies and desk accessories such as pen sets, letter openers and paperweights are typically used to commemorate an event or memorialize an achievement. Plaques are typically designed to be wall mounted and may include descriptive labels, emblems, photographs or simple figurines attached to the front of the plaque. Desk sets are usually modified to accommodate such commemorative items as emblems, labeling inserts or a simple figurine. Trophies generally consist of a base supporting an object or a figurine. Although some trophies may have a combination of objects positioned on the base, e.g., a golfer figurine and a flag at a hole, none of the trophies are designed to be horizontal and provide a substantially detailed re-creation or representation of a desired competitive or memorable event. For example, none of these objects are designed to depict the particular persons participating in an event, the environment in which the event occurred or, for competitive events, a physical representation of the order of finish by the participants in the event.

SUMMARY OF THE INVENTION

The present invention provides a horizontal trophy for representing an event to be memorialized. The horizontal trophy has an elongated base for supporting attached articles which collectively combine to provide a detailed portrayal of the event. For example, the articles attached to the horizontal base may include figures and materials which are arranged to depict a car race, golf tournament, tractor pull, ski competition, track meet, horse race or any other event which is desired to be memorialized. The base is labeled to display information regarding the event that is being depicted.

DETAILED DESCRIPTION OF THE INVENTION

Figure 1:
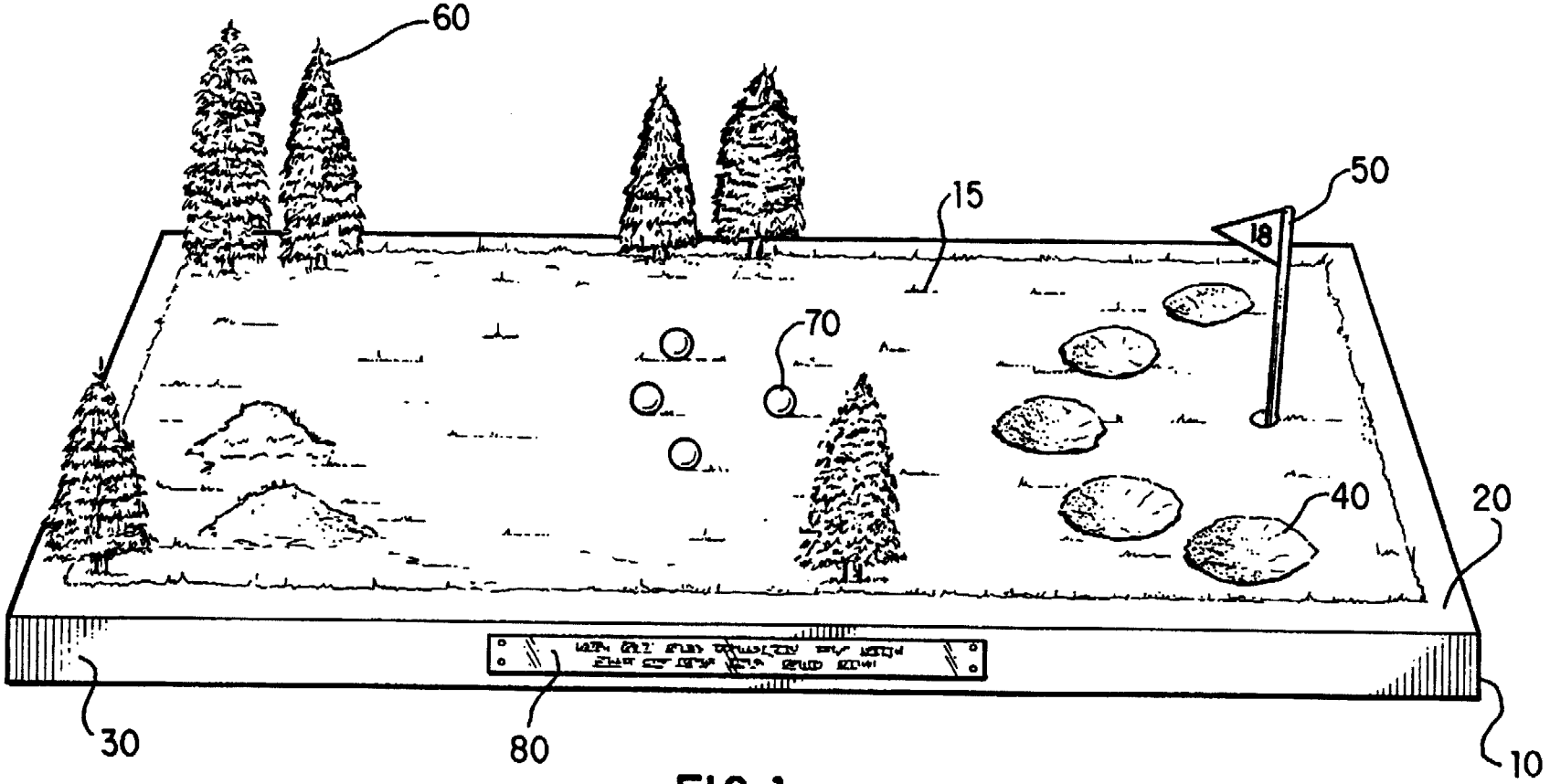
FIG. 1 illustrates one embodiment for a horizontal trophy according to the present invention which depicts the order of finish for a golf competition.
Figure 2:
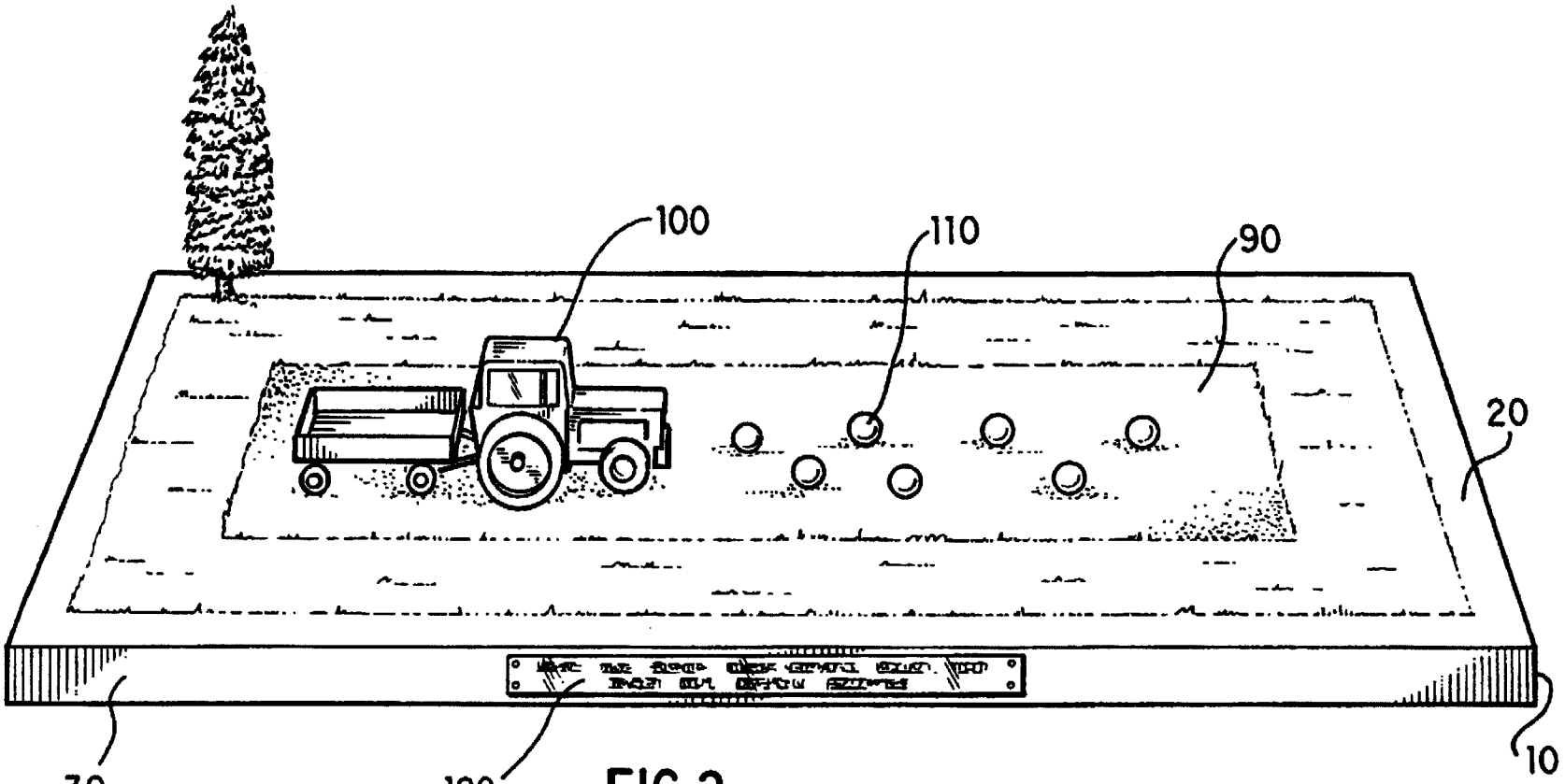
FIG. 2 illustrates a second embodiment for a horizontal trophy according to the present invention which depicts the order of finish for a tractor pull.

As illustrated in FIGS. 1 and 2, the horizontal trophy includes a substantially elongated, horizontal base 10 having an upper surface 20 and a peripheral edge surface 30. Attached to the upper surface 20 of the base are a variety of articles which are selected and arranged to memorialize a desired event. For example, FIG. 1 illustrates a horizontal trophy which depicts the order of finish for a golf competition to determine which player could hit the longest drive toward a particular hole on a golf course. The elongated base 10 of the trophy is constructed of wood and is approximately 5.5×2×0.5 in. A synthetic, green-colored, particulate material such as an all-purpose landscaping material (available from Life-Like Products, Inc, in Baltimore, Md.) is adhesively bonded to the upper surface 20 of the base to represent grass 15.

The surface of the base is modified by grinding or chiseling to form various depressions 40 indicating the location of sandtraps surrounding a hole, and a fine grained sand is adhesively bonded to the surface of the depressions 40 to more realistically depict the sandtraps. In addition, one or more of the depressions can be water-sealed so that the hole can be filled with water to represent a water hazard. A hole flag 50 is made from a thin length of wood with a piece of fabric attached and labeled to indicate the hole. The trees and shrubs 60 are adhesively bonded to the base and are comprised of artificial greenery available from craft and hobby stores. Small plastic balls 70 are attached to the base to represent the distance each player hit the golf ball. Each ball 70 is numbered or otherwise labeled to indicate which player is associated with a given ball 70. The trophy is then labeled 80 on an edge surface to indicate the location and date of the event.

FIG. 2 illustrates another horizontal trophy which depicts a tractor pull. As described above for FIG. 1, similar materials are used to represent the grass, trees and shrubs. The dirt track 90 is made by bonding a synthetic, earth-colored, particulate material such as an all-purpose landscaping material (available from Life-Like Products, Inc, in Baltimore, Md.) to the base. A miniature tractor 100 is attached, and small plastic balls 110 are attached to indicate an order of finish. The balls 110 are labeled to indicate a respective participant. A label 120 containing information about the event is attached to the base 10 of the trophy.

When constructing a horizontal trophy, various synthetic or natural materials are available to construct the memorialized scene. Such materials include miniature figures, structures and vehicles as well as artificial greenery, fabric and clay. The articles can be attached to the base by a variety of means, including adhesives such as glue or liquid cement; or by mechanical attachment such as tacks, nails, Velcro™ or staples.

The horizontal base may be labeled to indicate the event being memorialized or provide other relevant information relating to the event. This labeling may be formed into a portion of the horizontal base or may be attached to an area of the horizontal base such as at an edge surface. To increase the visibility of the labeling, a peripheral edge of the trophy containing the label may be finished at an angle. Acceptable materials for the base include, but are not limited to, wood, plastic, rigid foam, glass, metal and stone, as long as the material is capable of supporting the attached figures.

It is to be understood that the form of the invention disclosed herein is to be taken as a preferred example of the invention, and that various changes or modifications may be made without departing from the spirit of the invention or scope of the following claims.

What is claimed is:

1. A substantially horizontal trophy for depicting an event to be memorialized, comprising:

an elongated base having a substantially planar upper surface and a peripheral edge surface; and a plurality of articles attached to at least the upper surface of the base, wherein said articles depict the event to be memorialized and wherein at least two of said articles are positioned relative to each other such that the positioning of said at least two articles represents the results of at least two participants in the event to be memorialized at any point in time the conduct of the event.

2. The trophy of claim 1 wherein the elongated base is a material selected from the group consisting of: wood, metal, glass, plastic, rigid foam or stone.

3. The substantially horizontal trophy for depicting an event to be memorialized of claim 1 further comprising a label on the elongated base for providing information about the memorialized event.

4. The trophy of claim 3, wherein the label comprises text formed into a surface of the elongated base.

5. The trophy of claim 3 wherein the label is attached to the peripheral edge surface of the elongated base.

6. The substantially horizontal trophy for depicting an event to be memorialized of claim 1 wherein the event to be memorialized is a sporting event.

7. The substantially horizontal trophy for depicting an event to be memorialized of claim 6 wherein the sporting event is a golf event.

8. The substantially horizontal trophy for depicting an event to be memorialized of claim 7 wherein the golf event is a long drive competition.

9. The substantially horizontal trophy for depicting an event to be memorialized of claim 6 wherein the sporting event is a horse race.

10. The substantially horizontal trophy for depicting an event to be memorialized of claim 1 wherein the event to be memorialized is a tractor pull competition.

11. A method of depicting an event to be memorialized, comprising the steps of:

providing a horizontal base, the base being substantially elongated and having an upper surface and a peripheral edge surface;

positioning a plurality of articles on said horizontal base wherein said articles depict the event to be memorialized and wherein at least two of said articles are positioned relative to each other such that the positioning of said at least two articles represents the results of at least two participants in the event to be memorialized at any point in time during the conduct of the event; and attaching said articles to said horizontal base.

12. The method of depicting an event to be memorialized of claim 11 further comprising the step of labeling the horizontal base.

13. The method of depicting an event to be memorialized of claim 11 wherein the event to be memorialized is a sporting event.

14. The method of depicting an event to be memorialized of claim 13 wherein the sporting event is a golf event.

15. The method of depicting an event to be memorialized of claim 14 wherein the golf event is a long drive competition.

16. The method of depicting an event to be memorialized of claim 13 wherein the sporting event is a horse race.

17. The method of depicting an event to be memorialized of claim 11 wherein the event to be memorialized is a tractor pull competition.

* * * * *

UNITED STATES PATENT AND TRADEMARK OFFICE

CERTIFICATE OF CORRECTION

PATENT NO. : 5,698,334

DATED : 16 December 1997

INVENTOR(S) : Linus I. BERENS

It is certified that error appears in the above-identified patent and that said Letters Patent is hereby corrected as shown below:

| Column | Line | |
|---|---|---|
| 1 | 63 | Change "5.5x2x0.5" to --5.5x24x0.5--. |
| 2 | 63 | After "time" insert --during--. |

Signed and Sealed this

Ninth Day of June, 1998

*Attest:*

*Attesting Officer*

Bruce Lehman

BRUCE LEHMAN

*Commissioner of Patents and Trademarks*